United States Patent [19]

Mayer et al.

[11] Patent Number: 4,579,542

[45] Date of Patent: Apr. 1, 1986

[54] ACTION FIGURE WITH ARM MOVEMENT DERIVED FROM LEG MOVEMENT

[75] Inventors: John F. Mayer, Fort Thomas, Ky.; Nick H. Langdon, Cincinnati, Ohio; Stuart A. Cook, New Richmond, Ohio; Harvey G. Springer; Raymond J. Drake, both of Cincinnati, Ohio; John R. Belcher, Opelika, Ala.

[73] Assignee: CPG Products Corp., Minneapolis, Minn.

[21] Appl. No.: 574,825

[22] Filed: Jan. 30, 1984

[51] Int. Cl.[4] ..... A63H 3/20

[52] U.S. Cl. ..... 446/330; 446/336; 446/379

[58] Field of Search ..... 446/317, 330, 334–336, 446/339, 340, 352–355, 358, 365–366, 381, 379, 383, 380, 390, 144, 145

[56] References Cited

U.S. PATENT DOCUMENTS

| | | | |
|---|---|---|---|
| 140,259 | 6/1873 | Eaton | 446/158 |
| 525,716 | 9/1894 | McElroy | 446/355 |
| 1,210,266 | 12/1916 | Bickelhaupt | 446/330 |
| 1,323,153 | 11/1919 | Calkins | 446/339 |
| 1,359,778 | 11/1920 | Zimmerman | 446/330 |
| 1,645,228 | 10/1927 | Christiansen | 446/330 |
| 1,800,775 | 4/1931 | Bostwick | 446/379 |
| 2,288,371 | 6/1942 | Rothschild | 446/354 |
| 2,637,940 | 5/1953 | Fugitt | 446/359 |
| 3,147,566 | 9/1964 | Ong | 446/377 X |
| 3,835,581 | 9/1974 | Grieder | 446/158 |

FOREIGN PATENT DOCUMENTS

| | | | |
|---|---|---|---|
| 1042944 | 11/1953 | France | 446/353 |
| 450779 | 1/1950 | Italy | 446/158 |
| 243729 | 11/1925 | United Kingdom | 446/355 |

*Primary Examiner*—F. Barry Shay

*Attorney, Agent, or Firm*—Gene O. Enockson; L. MeRoy Lillehaugen; Stuart R. Peterson

[57] ABSTRACT

The action figure includes two pivotally mounted arms and one leg that can be rocked about a perpendicular axis. In one embodiment, the arms are mounted for pivotal movement about a common horizontal axis, whereas in a second embodiment the arms are mounted for pivotal movement about inclined axes. In either event, an actuating mechanism transmits motion from the leg that is rocked to either or both arms, doing so via either a single or double rotatable cam arrangement. The cam or cams have spiral ribs thereon by which a laterally moved follower converts its lateral movement into rotary movement for either or both arms. Where the arm axes are inclined, a cog arrangement is used which engages in a cruciformly-shaped recess on the arm mounting units so that rotation of the cam about a horizontal axis is transmitted to the arms along their inclined axes.

18 Claims, 18 Drawing Figures

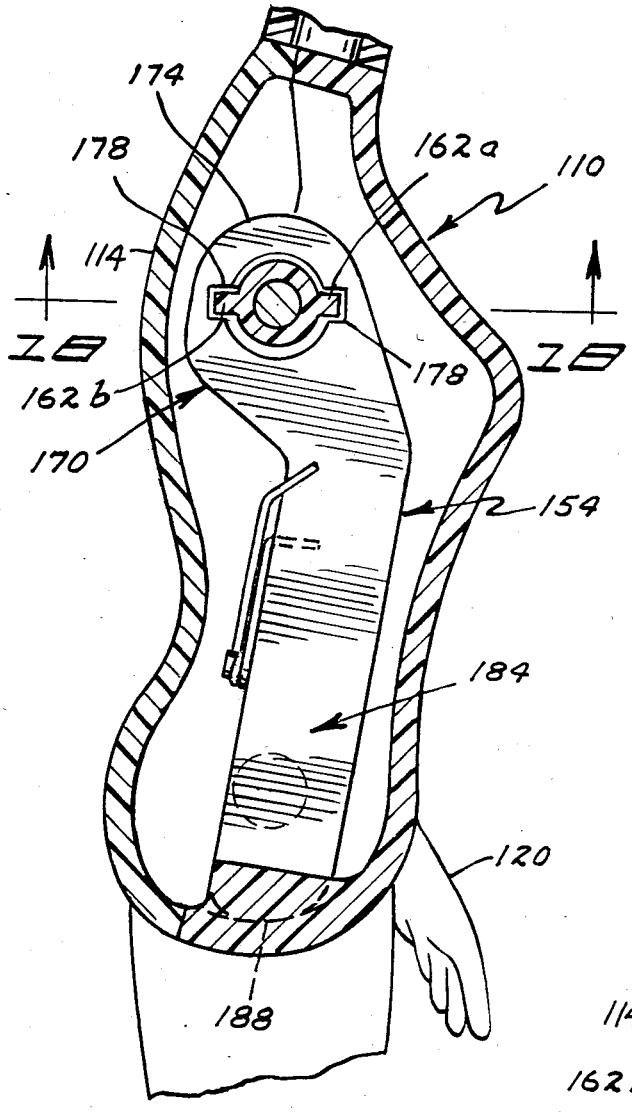
FIG. 16
FIG. 17
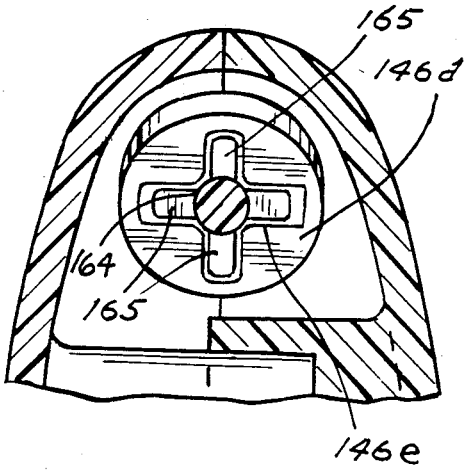
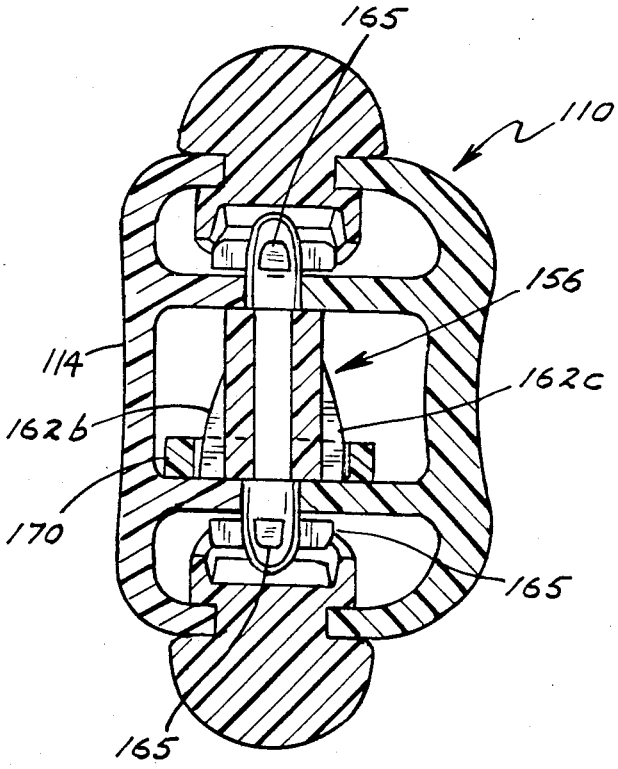
FIG. 18

ACTION FIGURE WITH ARM MOVEMENT DERIVED FROM LEG MOVEMENT

BACKGROUND OF THE INVENTION

1. Field of the Invention

This invention relates generally to toy figures having movable limbs, and pertains more particularly to an action figure in which the manual movement of one leg in a particular direction causes movement of at least one arm.

2. Description of the Prior Art

The patent literature is replete with disclosures of various dolls and the like in which various limb movements are produced. One such doll is described in U.S. Pat. No. 4,069,613, granted on Jan. 24, 1978 to Jerome H. Lemelson et al, titled "ACTIVITY DOLL." While this particular doll possesses a relatively simple actuating mechanism, it does involve a push-button type of manipulation in order to move either an arm or a leg.

Examples of dolls having multiple limb movements that are derived from the movement of but one limb are exemplified in U.S. Pat. No. 2,761,243, issued to Edmund W. Baggott on Sept. 4, 1956 for "WALKING AND CRAWLING DOLL", U.S. Pat. No. 2,978,834, issued on April 11, 1961 to Robert Gardel et al for "DOLL CRAWLING MECHANISM" and U.S. Pat. No. 2,978,835 granted on April 11, 1961 to Robert Gardel et al for "DOLL CRAWLING MECHANISM." Specifically, the alluded to patents are concerned with dolls that walk or crawl. Thus, while specific limb movements are planned, there is a disadvantage in having the movement of whatever limb is manipulated move in the same plane as the others move.

SUMMARY OF THE INVENTION

An object of the present invention is to provide an action figure in which a normal type of arm movement is produced by virtue of a special type of leg movement. In this regard, it is an aim of the invention to provide an action figure in which manipulation of one leg in a lateral direction will produce an arm movement of a specific type or types. In this regard, it is contemplated that one leg be moved manually toward the other leg and an actuating mechanism then cause one arm, or both arms, to swing in a plane parallel to the torso of the action figure or where both arms are pivotal by the foregoing leg movement, then both arms to be pivoted in parallel planes with respect to the torso or body of the action figure. It is also within the purview of the invention to derive an arm movement in which a simple leg manipulation will cause both arms to pivot into an arm-crossing relationship.

Another object of the invention is to provide an actuating mechanism that is completely housed within the action figure so that it is completely concealed from view, thereby enabling a realistic appearance to be imparted to the selected action figure. In this regard, it can be pointed out that an aim of the invention is to provide action figures that can simulate or resemble various comic strip personalities. In this regard, various arm movements are associated with certain well-known comic characters, and it is within the scope of the present invention to simulate such arm movements.

Yet another object of the invention is to provide an actuating mechanism that is inexpensive to manufacture, thereby enabling action figures employing the present invention to be manufactured and sold at a relatively low price. Also, it is an aim of the invention to provide an actuating mechanism that is simple, rugged and not apt to get out of order readily, thereby assuring a relatively long life for the toy.

Still further, an object of the invention is to provide an actuating mechanism that enables the particular figure to be miniaturized, yet still achieving the sought after limb movement or movements.

Another object of the invention is to provide a toy figure that will be appealing to children of various ages. In this regard, a goal of the invention is to provide an action figure having desired limb movements that can be effected via only a simple movement of another limb. More specifically, an aim of the invention is to provide an actuating mechanism in which the movement of one leg provides a motion-multiplying or lever-type action that results in a greater movement of one or both arms than the distance through which the leg is moved. It is also contemplated, when practicing the present invention, to derive an arm movement from the movement of a leg which rate of arm movement is not necessarily in proportion to the rate of movement of the leg from which the arm movement is derived. Stated somewhat differently, movement of the leg can produce an arm movement that is more rapid at the beginning of its movement or more rapid at the end of its arm movement. Hence, when utilizing the teachings of the present invention, considerable versatility can be imparted to the particular action figure, thereby simulating a more realistic action that is desired, particularly where the toy is intended to resemble a well-known comic strip character.

Briefly, the present invention envisages a small action figure, which can be in the form of a human being, an animal or a fictitious comic strip character, in which the lateral movement of one leg toward the other leg causes one arm to pivot or swing in a somewhat normal direction parallel to the body of the figure. It is also planned that the movement of a single leg can cause movement of both arms. In this regard, where both arms move one arm can be moved in an opposite direction to the other arm. Also, it is planned that the arms move in a direction so they cross each other in front of the figure's body. The special rocking actuation of one leg toward the other causes an internally located actuating mechanism to produce the arm movement. The actuating mechanism includes a rotatable cam having a spiral rib thereon which transmits the rocking motion into rotary motion which is then transmitted to the particular arm to be swung. The arms of the figure, in one instance, can be pivotally mounted so as to swing about a common axis, or the arms can be mounted so as to swing about angled or inclined axes. Consequently, when practicing the instant invention, a variety of arm movements can be derived from a particular rocking movement of but one of the figure's legs.

BRIEF DESCRIPTION OF THE DRAWINGS

FIG. 6 is a vertical sectional view taken in the direction of line 6—6 of FIG. 5;

FIG. 16 is a sectional view taken in the direction of line 16—16 of FIG. 14, the scale being somewhat reduced;

FIG. 17 is a sectional detail taken in the direction of line 17—17 of FIG. 14, and FIG. 18 is a sectional view taken in the direction of line 18—18 of FIG. 16.

DESCRIPTION OF THE PREFERRED EMBODIMENTS

Figure 10:
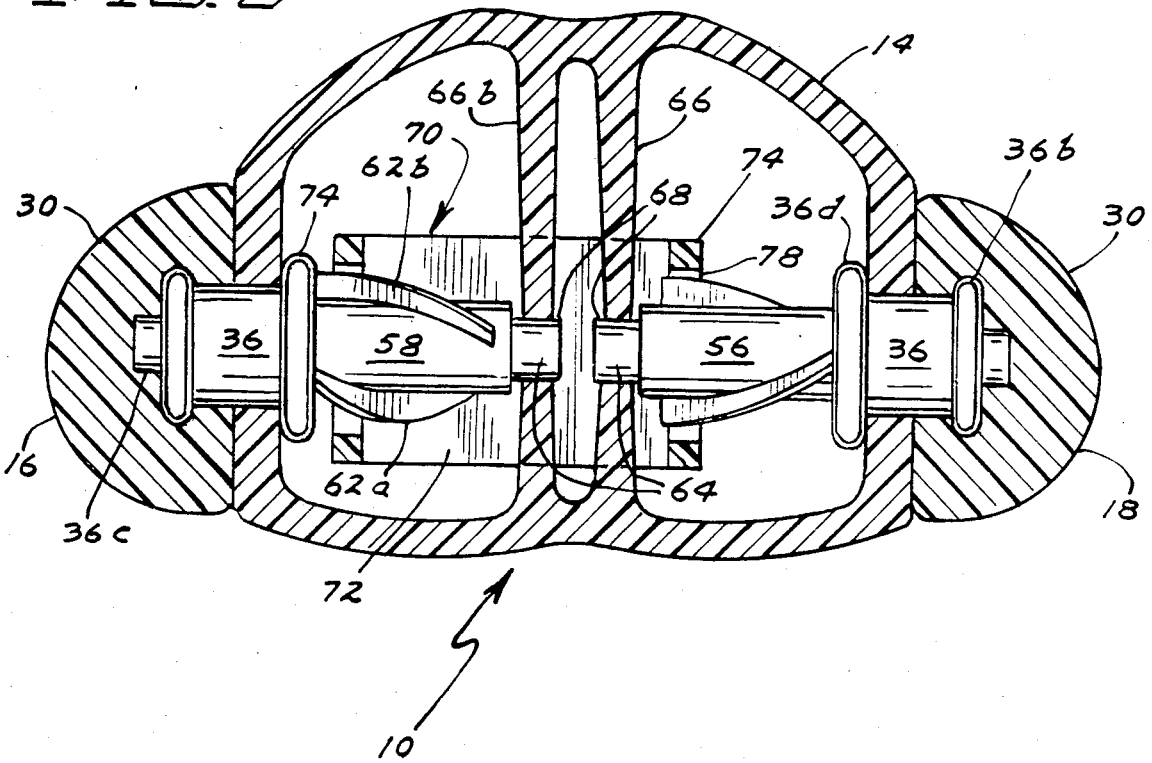
FIG. 10 is a horizontal sectional view taken in the direction of line 10—10 of FIG. 7.
Figure 11:
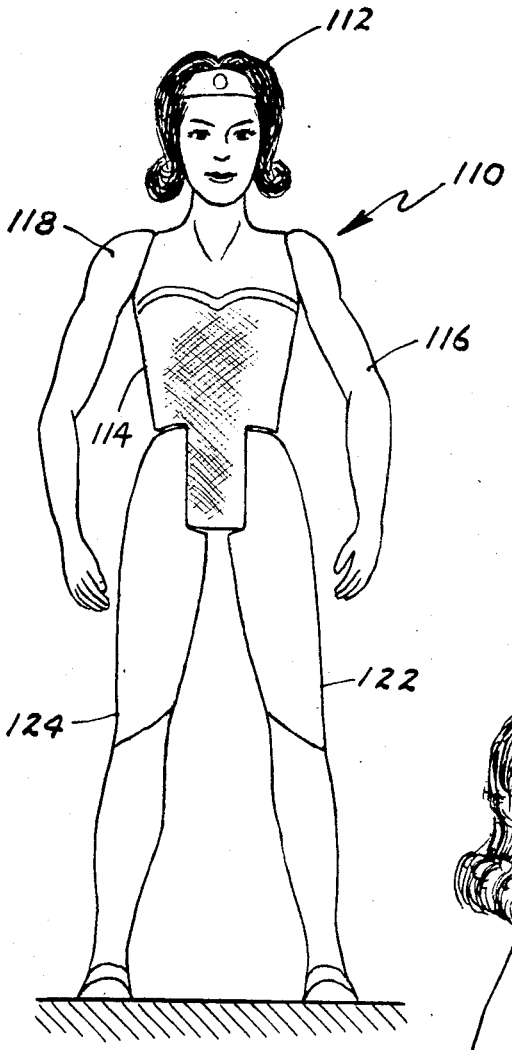
FIG. 11 is a front view of a female action figure illustrating a modified form of the invention, the view depicting the figure in an unactuated condition.

The first embodiment illustrating the invention appears in FIGS. 1-10. In this regard, it is to be observed that the toy is fabricated in the form of a male action figure denoted generally by the reference numeral 10. The action figure 10 includes a head 12 and a hollow torso 14, the torso 14 being comprised of two plastic shells suitably secured together. The action figure 10 additionally includes a left arm 16, a right arm 18, each arm having a hand 20. Still further, the figure 10 is provided with a left leg 22 and a right leg 24, each leg having a knee 26 and a foot 28. Although not pertinent to the present invention, it can be pointed out that each knee 26 can flex to simulate an actual knee movement.

In the present instance, it is intended that both arms 16 and 18 be capable of pivotal movement, more specifically in opposite directions and in planes substantially parallel to the sides of the torso 14. The manner in which the pivotal action of the arms 16 and 18 is achieved is perhaps best understood from FIGS. 5 and 7. From these two figures it will be observed that there is a shoulder labeled 30 for each arm 16, 18 having a socket 32 comprised of a bore 32*a*, an annular groove 32*b* and a counterbore 32*c*. Additionally, it is to be noted that the torso 14 is formed with a circular opening 34 at each side thereof.

Continuing with the description relating to the pivotal mounting of the arms 16 and 18, attention is directed to a spool-shaped arm mounting unit 36 having a sleeve or cylindrical portion 36*a* which is rotatable about a horizontal axis 37 passing through the center of the circular openings 34, a flange 36*b* which is pressed into the annular groove 32*b*, a cylindrical tip 36*c* which extends into the counterbore 32*c* plus a second flange 36*d* that functions as a thrust bearing to prevent movement of the shoulder 30 of each arm 16 and 18 outwardly along the horizontal axis 37 about which the spool-shaped arm mounting unit 36 is intended to rotate.

While there exists a choice of plastic materials that can be employed in manufacturing the action figure 10, it perhaps should be pointed out at this stage of the description that the torso 14 can be of ABS plastic, whereas the arms 16 and 18 are preferably of a more resilient plastic, such as vinyl. When using a vinyl plastic for the arms 16 and 18, it will be understood that the shoulders 30 of the arms 16, 18 can be pressed over the spool-shaped arm mounting unit 36, more specifically, its flange 36*b*, so that the arm 16 and 18 in each instance is constrained for pivotal movement when the arm mounting unit 36 for that particular arm is rotated within its circular opening 34. The press fit need not be so tight as to prevent independent manual pivoting of either arm 16 or 18 relative to its particular arm mounting unit 36; it is just that when practicing the present invention it is intended that the arm mounting units 36, there being one for each arm 16 and 18, cause pivotal movement of the particular arm 16 or 18 with which the arm mounting unit 36 is associated.

At this time it will be observed that each leg 22 and 24 has a hip labeled 38. The hip 38 in each instance includes a socket 40 comprised of a bore 42*a*, an annular groove 42*b* and a counterbore 42*c*. Corresponding generally to the circular openings 34 is an opening indicated by the numeral 44, the opening 44 being in the lower portion of the torso 14.

Insofar as the left leg 22 is concerned, there is a leg mounting unit 46 comprised of a sleeve or cylindrical portion 46*a* passing through the center of the opening 44, a flange 46*b* that is press fitted into the annular groove 42*b*, a cylindrical tip 46*c* that extends into the counterbore 42*c* and a thrust flange 46*d* that retains the leg mounting unit 46 in place. The unit permits the leg 22 to be independently rotated, the press fit permitting this, if desired.

Figure 5:
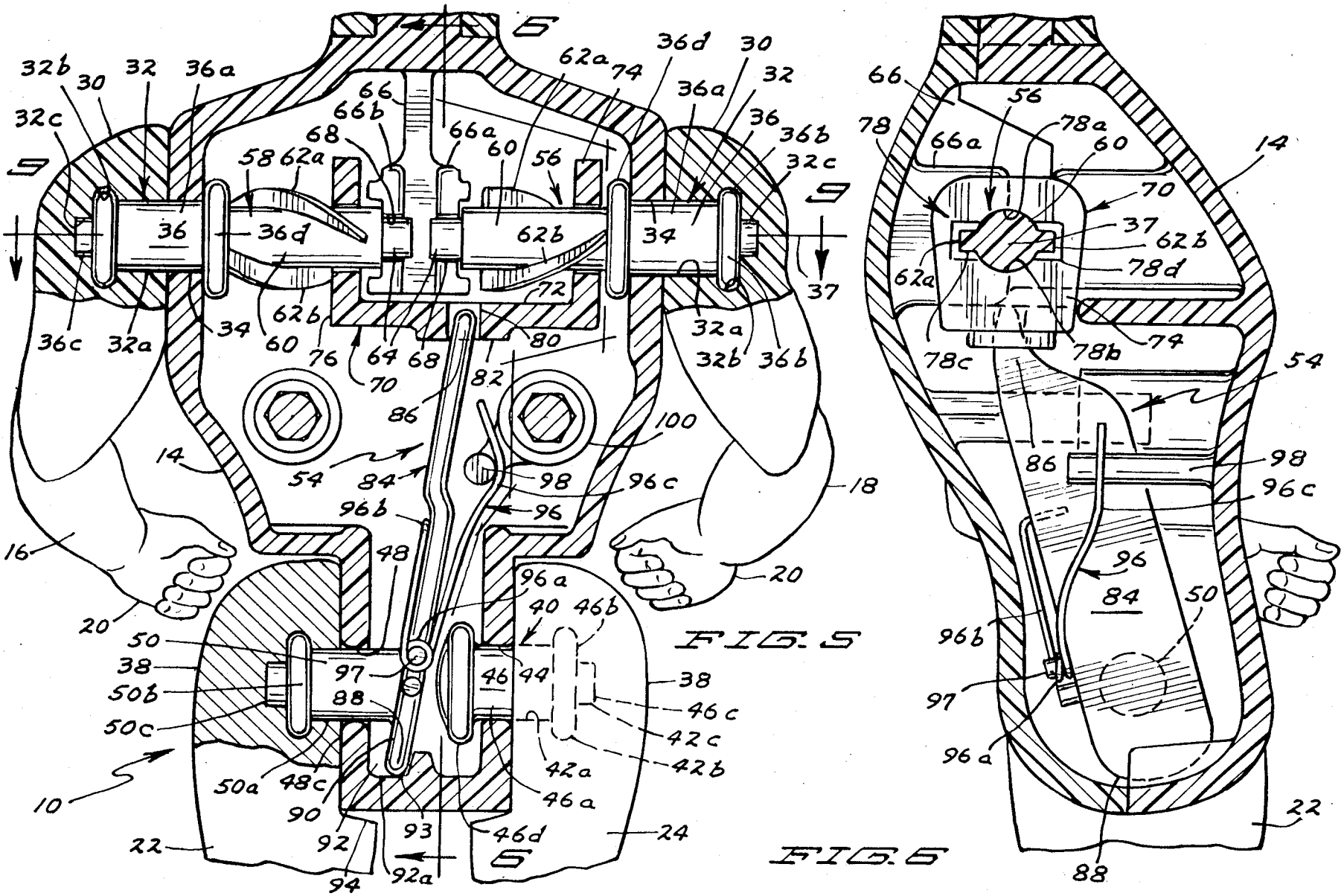
FIG. 5 is a greatly enlarged vertical sectional view taken in the direction of line 5—5 of FIG. 2.
Figure 8:
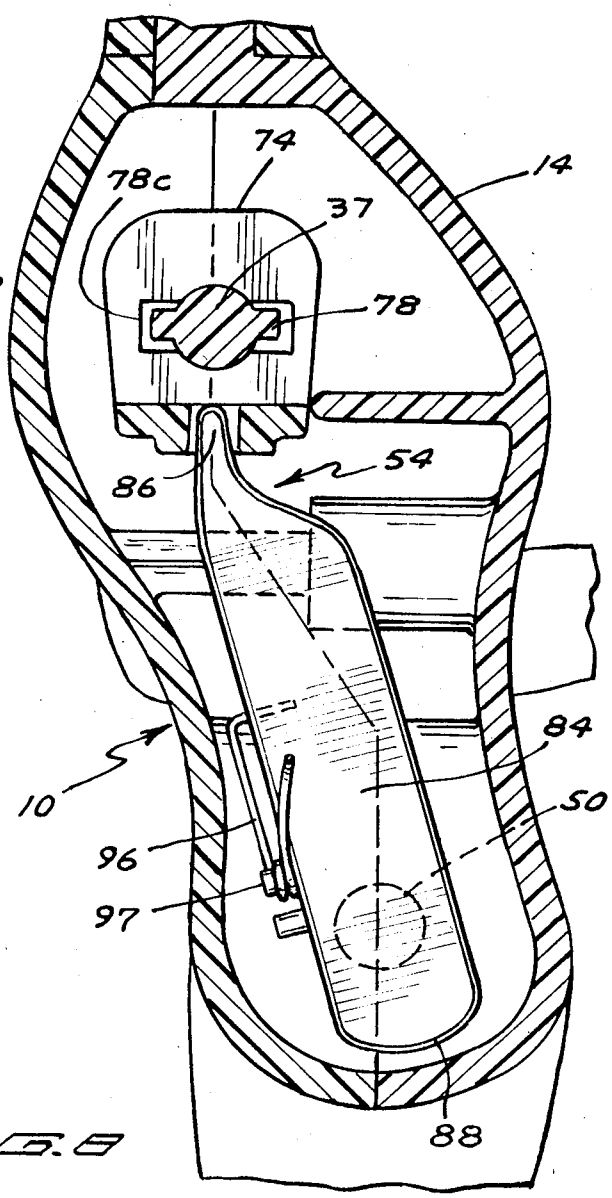
FIG. 8 is a vertical sectional view taken in the direction of line 8—8 of FIG. 7.
Figure 7:
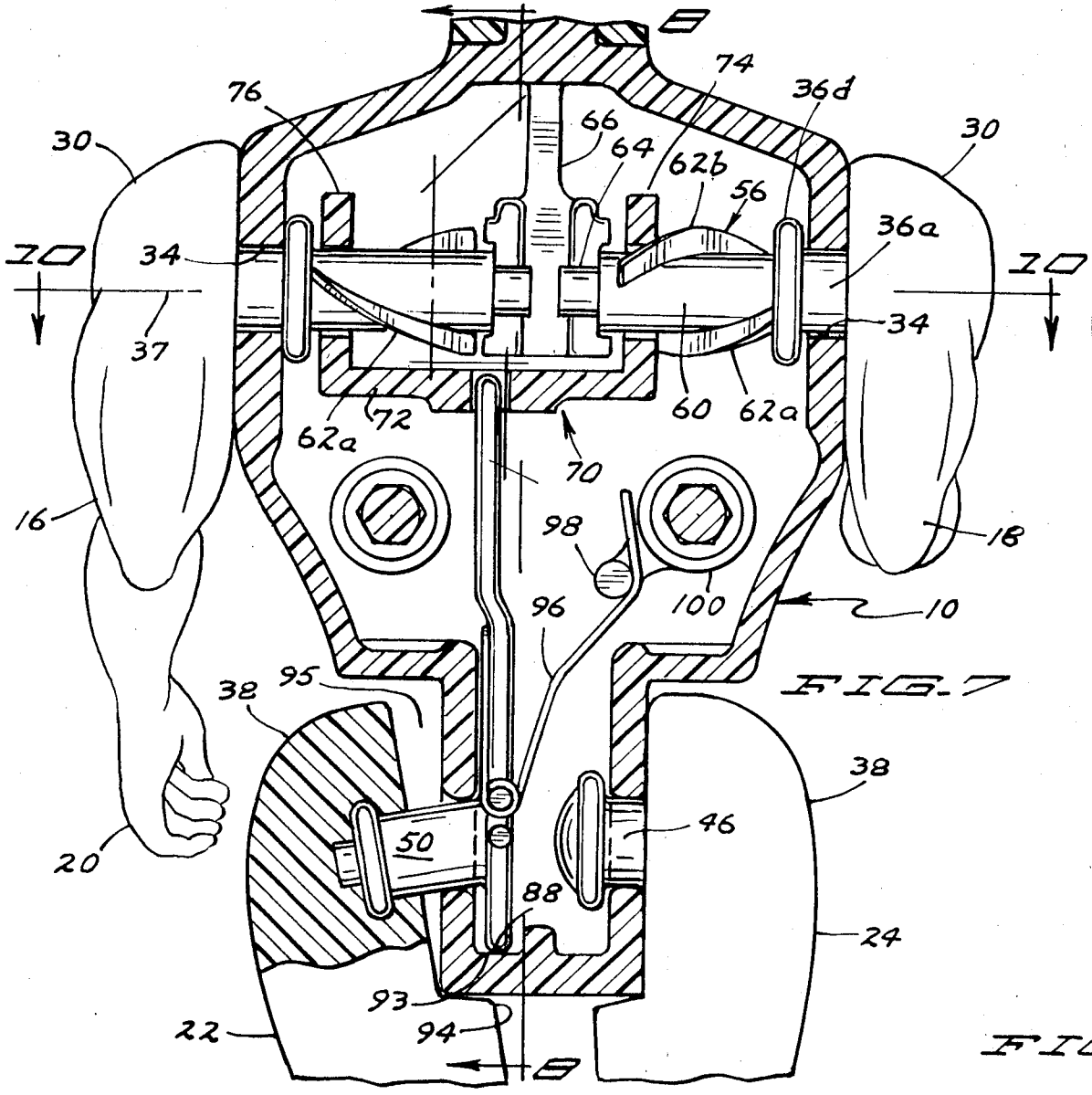
FIG. 7 is a greatly enlarged vertical sectional view taken in the direction of line 7—7 of FIG. 4.
Figure 9:
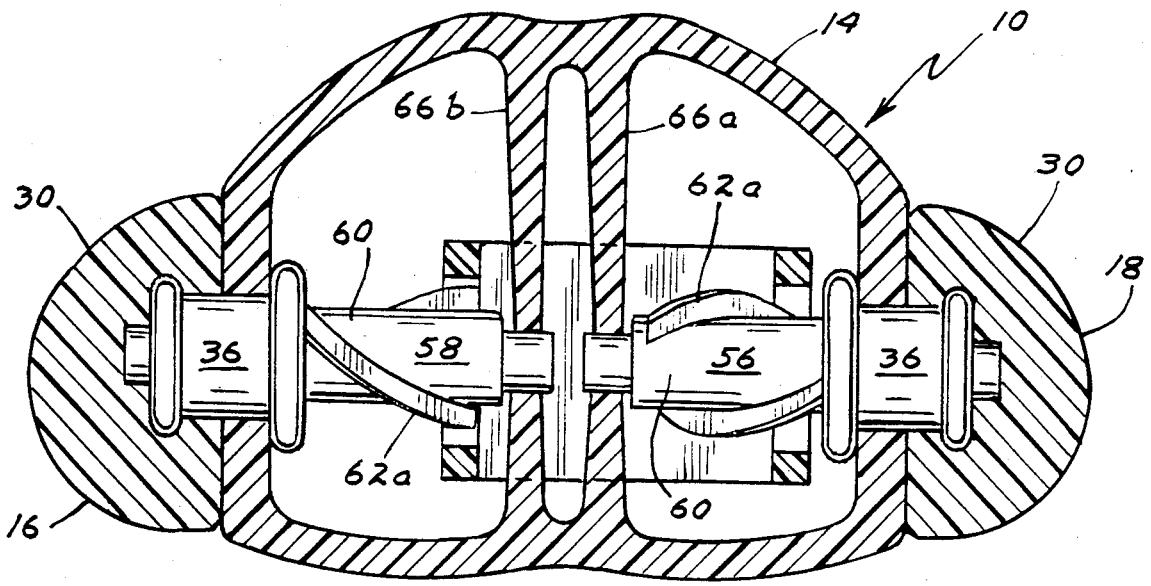
FIG. 9 is a horizontal sectional view taken in the direction of line 9—9 of FIG. 5.

In this instance, a second circular opening 48 is formed in the lower portion of the torso 14, the opening 48 differing from the opening 44 by virtue of it having a rounded cross section indicated by the reference numeral 48*a* in FIGS. 5 and 7.

Referring now to a specially configured leg mounting unit 50 for the right leg 24, it will be discerned that the leg mounting unit 50 includes a sleeve or cylindrical portion 50*a* that is received or passes through the opening 48, a circumferential flange 50*b* that is press fitted into the annular groove 42*b* and a cylindrical tip 50*c* that extends into the counterbore 42*c* of the right hip 38. It will be discerned that the sleeve 50*a* corresponds generally in appearance to the sleeve 46*a*, the flange 50*b* to the flange 46*b*, and the tip 50*c* to the tip 46*c*. For the sake of facile description, only the portions 50*a*, 50*b* and 50*c* are to be considered as constituting the leg mounting unit 50.

What will be referred to now is an actuating mechanism, indicated in its entirety by the reference numeral 54. The precise manner in which the actuating mechanism 54 is coupled to the leg mounting unit 50 is better reserved for later description. At this time, however, it is to be observed that the upper portion of the actuating mechanism 54 includes two rotatable cams 56 and 58, each cam having a cylindrical body portion 60 and each cylindrical body portion 60 having formed thereon angled means in the form of two spiral flights or ribs 62*a* and 62*b*. Each cam 56, 58 also has a stub shaft or cylindrical tip 64. As depicted, each rib 62*a* and 62*b* is in the form of a helix. However, the ribs 62*a* and 62*b* may possess a curvature differing from a true helix, the particular curvature or arcuate configuration of the ribs 62*a*, 62*b* depending upon the rate of pivotal arm movement that is desired relative to the rate at which the leg 24 is rocked. Stated somewhat differently, and this will become manifest as the description continues, it may be desired to simulate, say, a punching action with either or both arms 16, 18 in order to simulate an arm movement normally attributable to a given comic strip character. In such case either or both arms 16, 18 can be actuated at a faster rate during the initial portion of the punch.

From FIGS. 5, 6 and 7 it can be perceived that the torso 14 is formed with a centrally located gusset-like bracket 66 composed of forwardly projecting and laterally spaced lugs 66*a* and 66*b*, each lug 66*a*, 66*b* having a notch 68 formed therein for journaling the stub shafts 64. In this way, each of the cams 56, 58 is rotatable about the horizontal axis 37. The outer ends of the cams 56, 58 are integral with the respective arm mounting units 36; thus, when the cams 56, 58 are rotated, the arm mounting units 36 are rotated in unison therewith (but in opposite directions).

Continuing with the description of the actuating mechanism 54, it will be seen that the mechanism 54 additionally includes a U-shaped follower member 70 comprised of a bight portion 72 and upstanding ears 74, 76 at the opposite ends of the bight portion 72. From FIGS. 6 and 8 it will be observed that the ears 74, 76 each have an opening 78. The opening 78 is formed with upper and lower arcuate edge segments 78*a* and 78*b*, respectively, these arcuate edges 78*a*, 78*b* being dimensioned so as to partially encircle the cylindrical body portion 60 of each of the two rotatable cams 56 and 58. The opening 78 in each ear 74, 76 additionally includes oppositely directed notches 78*c* and 78*d*, these notches 78*c* and 78*d* being dimensioned so as to receive therein portions of the spiral ribs 62*a* and 62*b*. Hence, it will be appreciated that as the follower member 70 is moved laterally, that is from the right in FIG. 5 to the left in FIG. 7, the ears 74 and 76 act against the spiral ribs 62*a* and 62*b* of the two rotatable cams 56 and 58 so as to cause both of the cams 56, 58 to rotate about the horizontal axis 37.

In accomplishing the lateral movement of the follower member 70, there is a vertically oriented circular hole 80 formed in the bight portion 72, there being an annular ring 82 that imparts depth to the hole 80. The hole 80 is made use of in effecting the lateral shifting of the follower member 70. To produce the lateral movement of the U-shaped follower member 70, the actuating mechanism 54 further includes a relatively flat rocker arm or transmission link 84 having an upwardly projecting pin or tip 86 that projects into the circular hole 80. Whereas the pin 86 is located at the upper end of the rocker arm or transmission link 84, the lower end of the member 84 is rounded at 88. The mounting unit 50 for the right leg 24 has already been referred to as including the sleeve 50*a*, the flange 50*b* and the tip 50*c*. The inner end of the sleeve 50*a*, it can now be stated, is integral with a lower portion of one side of the flat rocker arm or transmission link 84, the juncture of which has been indicated by the reference numeral 90. In practice, the sleeve 50*a* is simply molded to the arm or link 84.

It is to be noticed that there is a notch labeled 92 in the lower portion of the torso 14, the base of the notch 92 being identified by the reference numeral 92*a*. It is important to understand that the base 92*a* of the notch 92 provides a rocking axis 93 for the rocker arm or transmission link 84. In other words, the rocking movement of the leg mounting unit 50 will cause rocking movement of the arm or link 84 about the axis 93 which extends perpendicularly to the axis 37.

The rocking movement of the leg mounting unit 50 and the arm or link 84 integrally coupled thereto is achieved by manually moving the right leg 24 toward the left leg 22. Close inspection and comparison of FIGS. 5 and 7 will demonstrate that the left leg 22, more specifically its hip 38, is formed with a sloping edge at 94. In FIG. 5, the edge 94 forms a greater acute angle with respect to the lower end of the torso 14 than in FIG. 7. Whereas the hip 38 in FIG. 5 confronts the lower portion of the torso 14, being in a vertical plane, in FIG. 7 there is an angular gap denoted by the reference numeral 95 inasmuch as the hip 38 has been rocked so as to create the gap 95 in FIG. 7 as contrasted with no gap in FIG. 5. Once again, it is to be pointed out that the base 92*a* of the notch 92 provides the axis 93, which might also be construed as a fulcrum point, about which the lower end 88 of the rocker arm or transmission link 84 rocks.

Figure 1:
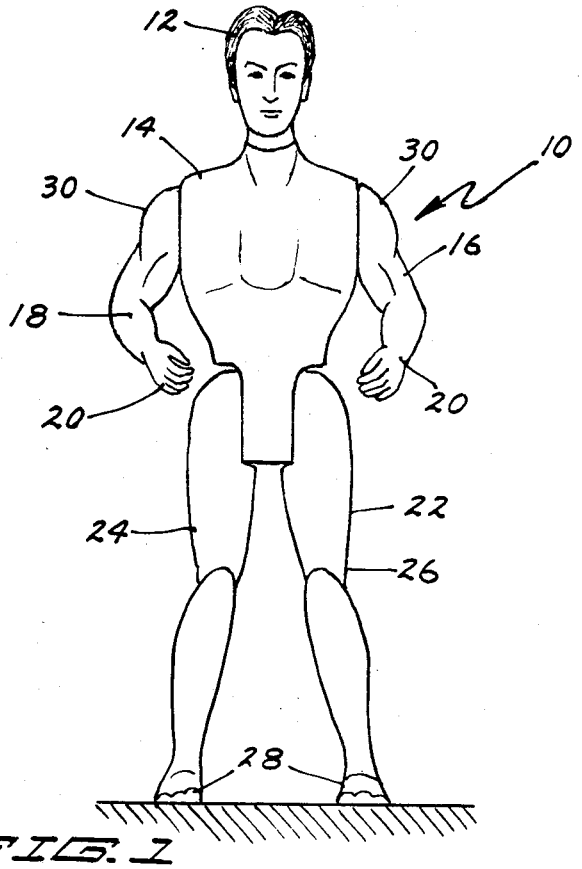
FIG. 1 is a front view of a male action figure illustrating one embodiment that the invention may assume, the view depicting the figure in an unactuated condition.
Figure 2:
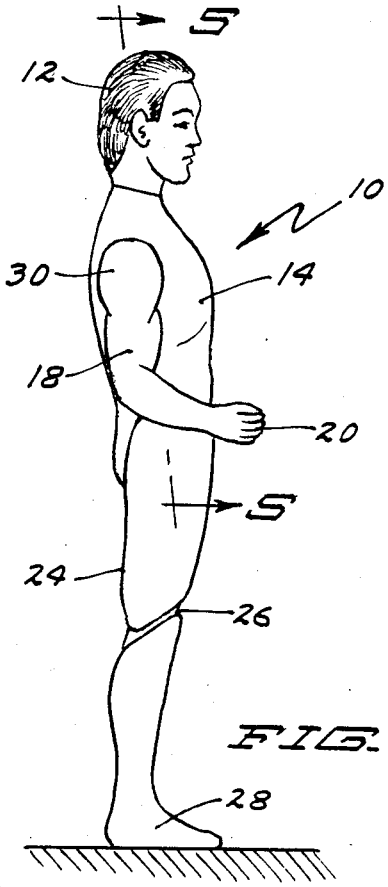
FIG. 2 is a side view of FIG. 1.
Figure 3:
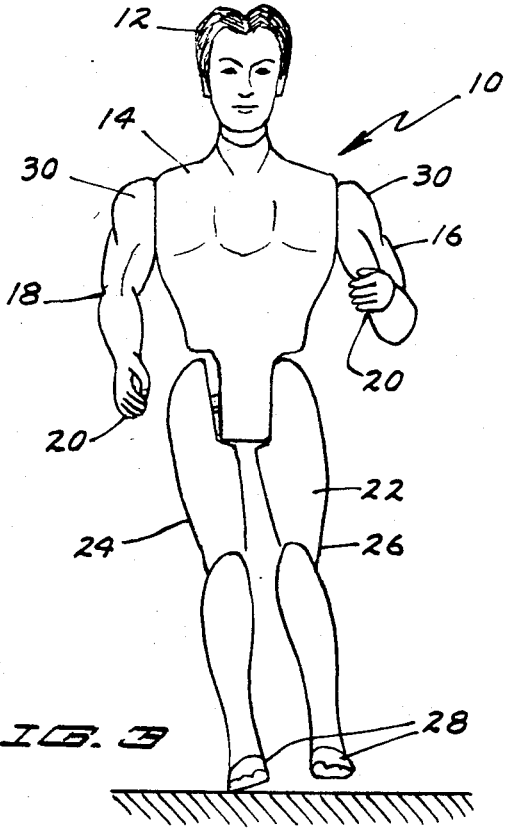
FIG. 3 is a front view corresponding to FIG. 1, but with the right leg actuated toward the left leg to cause pivotal movement of the arms in opposite directions.
Figure 4:
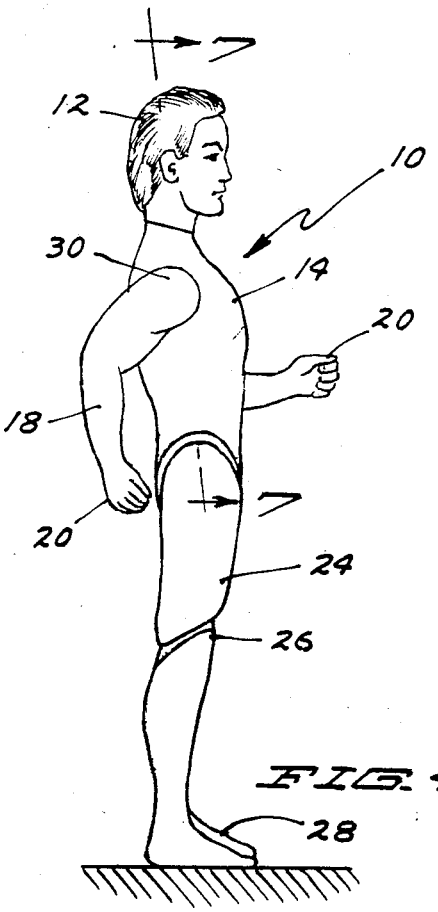
FIG. 4 is a side view of FIG. 3.

While it is planned that the child press the right leg 24 toward the left leg 22, a comparison of FIGS. 1 and 3 indicating the type of lateral or pincer-like movement that is intended, it is also planned that when the child releases the leg 24 that it be returned automatically back to its unflexed position appearing in FIG. 1. To do this, a generally U-shaped wire spring 96 is provided, the spring 96 having a coiled lower end 96*a* that fits over a pin 97 projecting from the forward edge of the arm or link 84. The U-shaped wire spring 96 additionally includes a spring segment 96*b* that bears against one side of the arm or link 84, and a spring segment 96*c* that is anchored between a pin 98 projecting forwardly from the inner rear side of the torso 14 and a bushing 100 that also projects forwardly from the rear inner side of the torso 14. It has been herein earlier mentioned that the torso 14 is comprised of two shells; the bushing 100, along with another bushing at the left (unnumbered), is made use of in securing the two shells together to form the hollow torso 14.

Having presented the foregoing description of the action figure 10, and to some degree its operation, it will be recognized that all that the child need do to produce pivotal movement of both arms 16 and 18 in opposite directions is to simply press in a pincer-like fashion the right leg 24 toward the left leg 22. In this regard, FIG. 5 depicts the normal or unactuated position of the leg 24, and of course the normal or unactuated relationship of the two arms 16 and 18. However, when the right leg 24 is rocked about the axis 93 from the position pictured in FIG. 5 to that illustrated in FIG. 7, the U-shaped follower member 70 is shifted from its rightmost position in FIG. 5 to its leftmost position in FIG. 7. It will be recognized that the arm or link 84, being integral with the leg mounting unit 50, is rocked through an angle sufficient to effect the lateral shifting of the member 70, as evidenced by comparison of FIG. 5 and FIG. 7.

It is during the movement of the U-shaped follower member 70 from the right to the left that the two rotatable cams 56 and 58 are caused to rotate about the axis 37 in that the spiral ribs 62*a* and 62*b* on the two cams 56 and 58 are acted upon by the ears 74 and 76. In this regard, the opening 78 in each ear 74 and 76 is configured so that the edges of the notches 78*c* and 78*d* ride along the spiral ribs 62*a* and 62*b* to produce such rotation.

Owing to the reverse direction of the spiral ribs 62*a* and 62*b* on the rotatable cam 58 contrasted with the direction these ribs 62*a* and 62*b* extend on the cam 56, the cams 56 and 58 are rotated in opposite directions. This results in the swinging of the arms 16 and 18 in opposite directions. More specifically, the left arm 16 is pivoted forwardly and the right arm 18 pivoted rearwardly, each moving in a plane parallel to the sides of the torso 14.

While both arms 16 and 18 are pivotally actuated in the embodiment portrayed by the action figure 10, it can be mentioned that either one of the cams 56 or 58 can be omitted so that only one arm pivots. A single arm movement is especially desirable when an arm-punching or karate-like movement is desired. As already mentioned, the spiral ribs 62*a* and 62*b* can possess a curvature that will accelerate the pivoting of an arm at the beginning of its pivotal movement or at the end. By the same token, when both arms 16 and 18 are intended to be swung, the curvature of the ribs 62*a* and 62*b* on the cam 56, for instance, can differ from the curvature imparted to the corresponding ribs 62*a* and 62*b* on the cam 58, thereby producing one rate of movement for, say, the left arm 16 and a different rate for the right arm 18.

Although believed obvious, it will be mentioned that the U-shaped spring 96 is responsible for returning the U-shaped follower member 70 back from its shifted position appearing in FIG. 7 to its unactuated or quiescent position shown in FIG. 5. This, of course, returns the arms 16, 18 from the position shown in FIG. 4 to the position illustrated in FIG. 2.

In an effort to demonstrate the versatility of the present invention, a second embodiment in the form of a female action figure 110 is pictured in FIGS. 11–18. Due to the similarity of parts, the digit "1" will be added to the particular reference numeral used in describing the action figure 10. Hence, the spool-like arm mounting unit 146 corresponds to the spool-like arm mounting unit 46 of the earlier-described embodiment 10. However, inasmuch as the arms 116 and 118 are to be pivoted about inclined axes 137*a* and 137*b*, as can be readily understood from FIGS. 14 and 15, the spool-like arm mounting units 146 differ somewhat from the corresponding units 46. In this regard, it will be perceived, particularly from FIG. 17, that the inner face of the flange 146*d*, which flange 146*d* corresponds generally to the flange 46*d*, has a cruciformly-shaped recess 146*e* formed therein. It will be appreciated that the recess 146*e*, as clearly discernible from FIG. 17, is formed with quadrantly located notches.

In the embodiment now being described, there is but a single rotatable cam 156 having spiral ribs 162*a* and 162*b* formed thereon. It should be understood, though, that the cam 156, unlike either of the cams 56 or 58, is not integral with either arm mounting unit 146 belonging to the arms 116 and 118.

Whereas each of the cams 56 and 58 is provided with a cylindrical tip or stub shaft 64, the cam 156 is provided with oppositely directed cylindrical tips or stub shafts 164 which are received in notches 168 provided in forwardly projecting lugs 166*a* and 166*b*. Each of the cylindrical tips or stub shafts 164 is provided with quadrantly located, radially extending cogs 165. The cogs 165 are dimensioned so as to successively extend into the quadrantly located notches provided by the cruciformly-shaped recess 146*e*. Actually, it is only one cog 165 that engages a particular notch of the recess 146*e* at any one time, this occurring at the twelve o'clock position, as when viewed in FIG. 17. The meshed engagement of the cog 165 that is uppermost with the particular notch of the recess 146*e* that is uppermost can also be understood from FIGS. 14 and 15.

Figure 14:
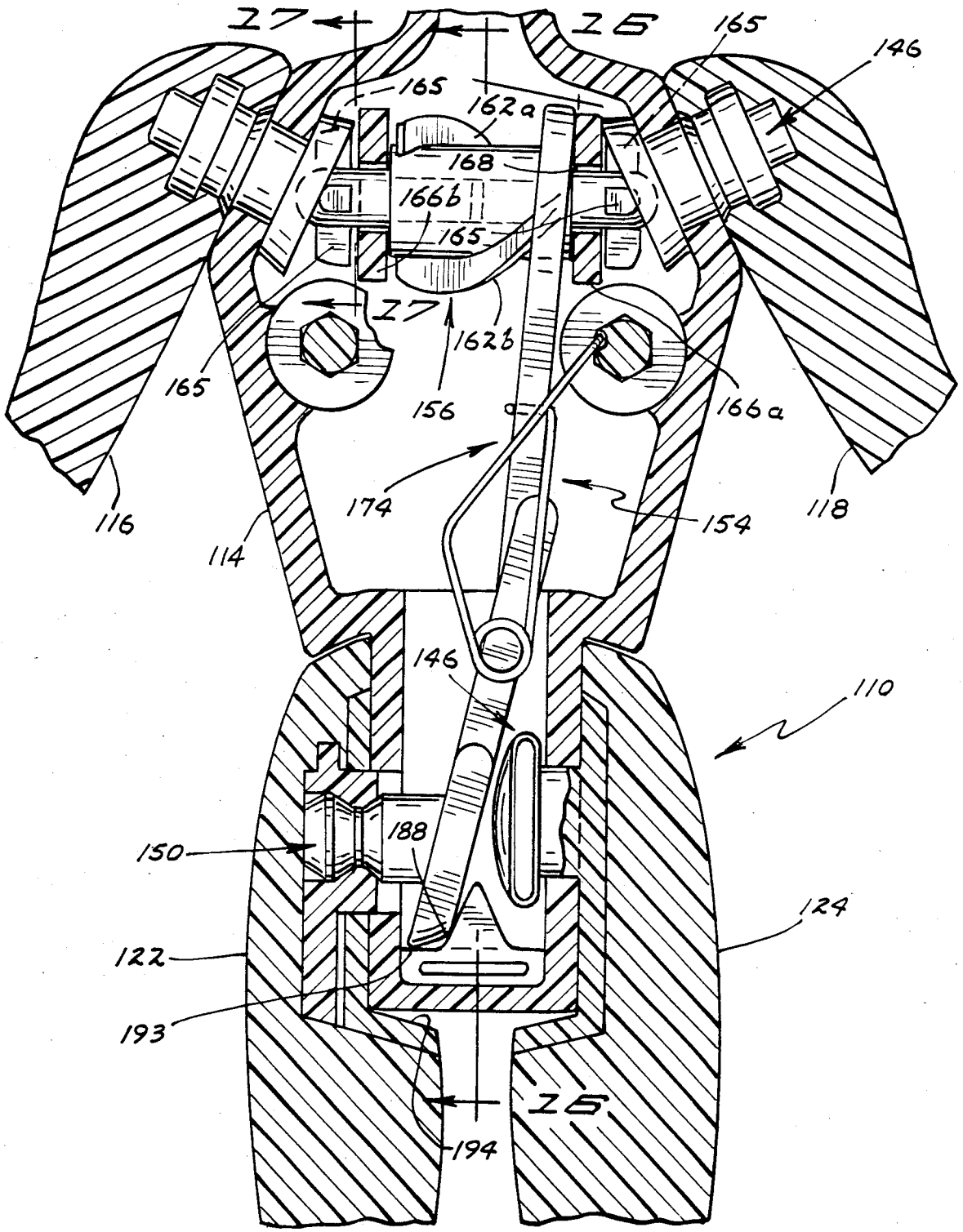
FIG. 14 is a vertical sectional view taken in the direction of line 14—14 of FIG. 13.
Figure 15:
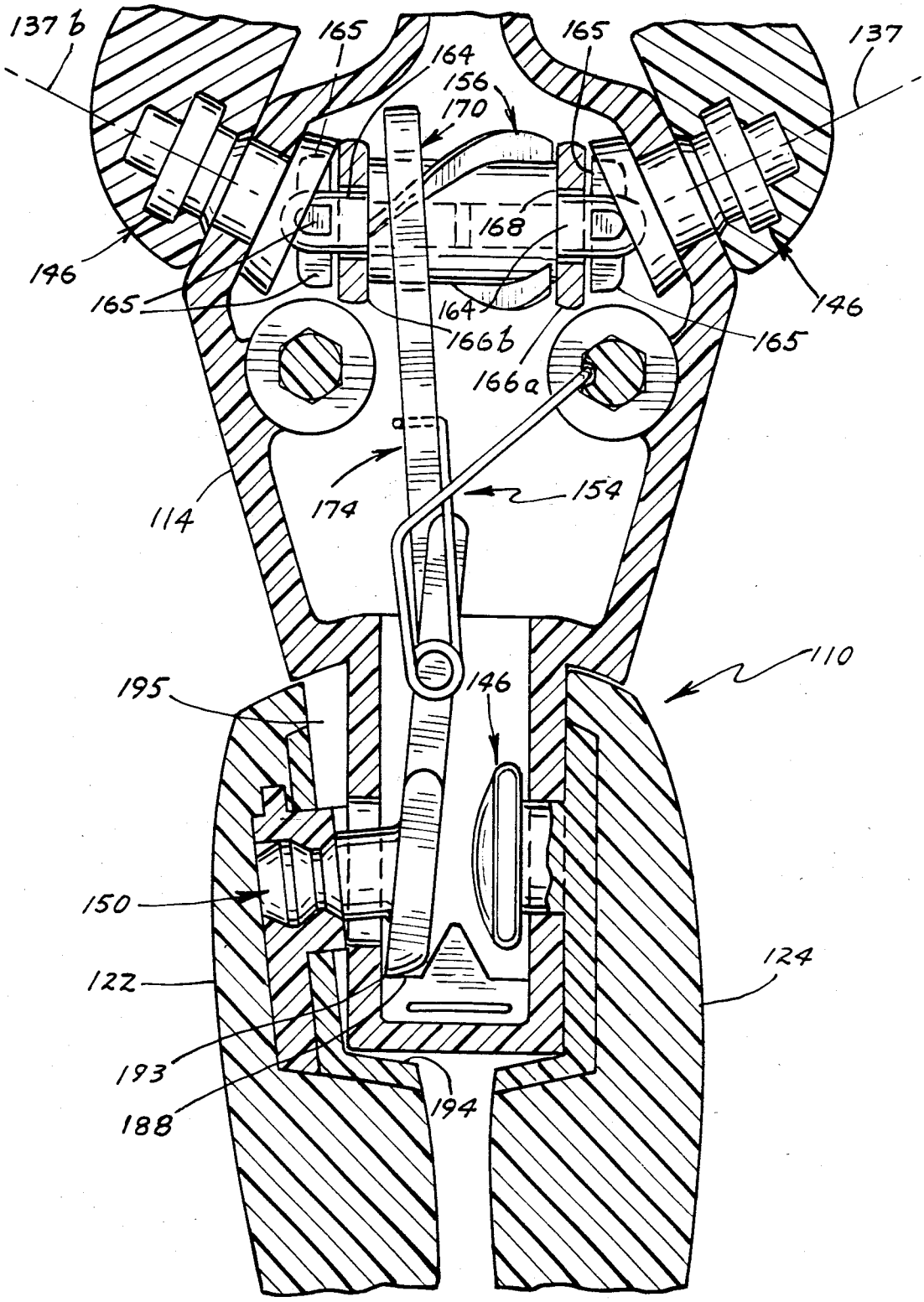
FIG. 15 is a vertical sectional view corresponding to FIG. 14 but with the right leg moved toward the left leg to raise and cross the arms.

The actuating mechanism 154, which corresponds to the actuating mechanism 54, differs in that the follower member 170 of the mechanism 154 is not U-shaped but is flat or planar. More specifically, the follower member 170 is integral with the upper end of the rocker arm or transmission link 184. The follower member 170 can be combined with the arm or link 184 in the embodiment now being described in that only a single cam 156 is employed in the action figure 110. The angled edge 194 enables the leg 124 to be rocked in the same fashion as the leg 24. This is portrayed in FIGS. 14 and 15, the edge 194 being closer to the bottom of the torso 114 in FIG. 15 than in FIG. 14. Witness also the gap labeled 195 which appears in FIG. 15 but which gap is absent in FIG. 14. In other words, FIG. 14 represents an unflexed or unrocked condition of the right leg 124, whereas FIG. 15 illustrates the leg 124 after it has been rocked. The leg-rocking action, as is believed evident by comparing FIGS. 14 and 15, is the same that occurs in the earlier-described embodiment.

Figure 12:
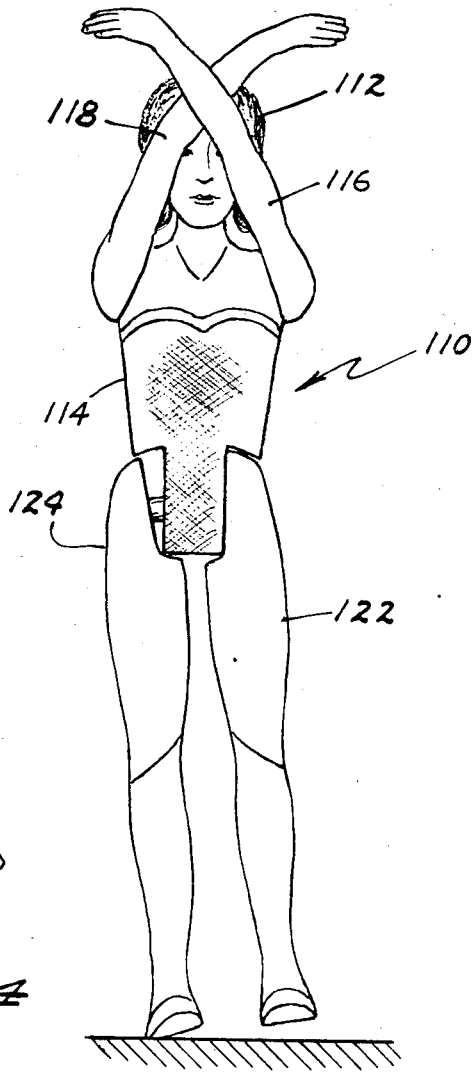
FIG. 12 is a front view corresponding to FIG. 11, but with the right leg actuated toward the left leg to cause the arms to pivot into their raised, crossed relationship.
Figure 13:
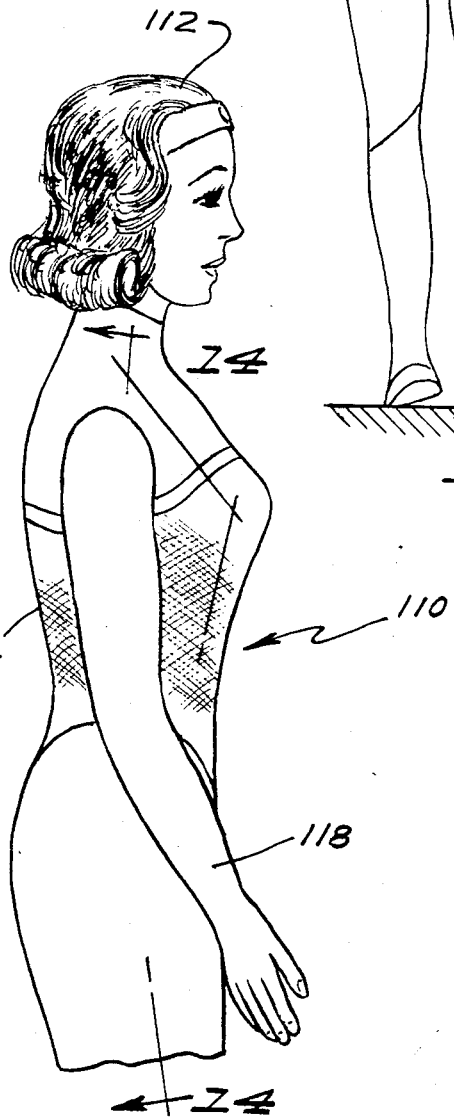
FIG. 13 is an enlarged side view of FIG. 11.

By reason of the inclined axes 137*a* and 137*b* that the arms 116, 118 pivot about is permitted by the universal-like coupling provided by the cogs 165 and their successive engagement in the notches of the cruciformly-shaped recess 146*e*. Hence, the arms 116 and 118 are swung upwardly from the position in which they appear in FIG. 11 to that in which they are shown in FIG. 12.

Consequently, by presenting the action figures 10 and 110, it should be recognized and appreciated that the present invention permits various arm movements to be effected by simply pressing one leg 24 or 124, as the case may be, toward the other leg 22 or 122. This is a simple procedure that can be accomplished by small children. There are no push buttons or other protuberances that would detract from the appearance of the particular action figure 10 or 110, it should be noted. Whether the actuating mechanism 54 or the actuating mechanism 154 is used, there is a motion-multiplying result in that the leg 24 or the leg 124, as the case may be, need be moved only slightly to produce a relatively great swing of the arms 16, 18 or 116, 118.

We claim:

1. A toy action figure comprising a hollow torso, first and second arms, first means mounting said first arm to said torso for pivotal movement about a first axis, first and second legs, second means mounting said first leg to said torso for rocking movement about a second axis, and an actuating mechanism within said torso connecting said first leg to said first arm for causing pivotal movement of said first arm about said first axis when said first leg is rocked about said second axis in a direction toward said second leg, said actuating mechanism including cam means coupled to said first means which includes a rotatable cam member having a spiral rib thereon and additional means coupled to said second means and engaged with said cam means for moving said cam means to effect pivotal movement of said first arm when said leg is rocked, and said additional means also including a follower member engaged with said spiral rib and movable along said rib to produce rotation of said cam member and pivotal movement of said first arm.

2. A toy action figure in accordance with claim 1 in which said additional means includes an angularly shiftable link member.

3. A toy action figure in accordance with claim 2 in which said follower member is separate from said link member.

4. A toy action figure in accordance with claim 3 including a second rotatable cam member connected to said second arm having a spiral rib thereon, said follower member being U-shaped to provide a bight portion and upstanding ears at the ends of said bight portion, said ears each having an opening therein providing a notch for receiving a respective one of said ribs and said bight portion having a hole therein, said link member having a tip projecting into said hole to shift said U-shaped follower member and its ears along both of said ribs to cause rotation of said cam members and pivotal movement of both of said arms.

5. A toy action figure in accordance with claim 4 in which said ribs extend in different angular directions so that said arms are swung in opposite directions.

6. A toy action figure in accordance with claim 2 in which said follower member includes a generally flat portion integral with said link member, said flat portion having an opening therein providing a notch for receiving said rib to cause rotation of said cam member when said follower member is shifted along said rib.

7. A toy action figure in accordance with claim 6 in which said first axis is inclined with respect to the axis of rotation of said cam member, said first mounting means including a face portion having a cruciformly-shaped recess therein, and said cam member having a plurality of cogs engageable in said cruciformly-shaped recess to transmit rotation from said cam member to said first mounting means to produce pivotal movement of said first arm about its said inclined axis.

8. A toy action figure in accordance with claim 7 including means mounting said second arm for pivotal movement about an axis inclined with respect to the axis of rotation of said cam member, said mounting means for said second arm including a face portion having a cruciformly-shaped recess therein, and said cam member having an additional plurality of cogs engageable in the cruciformly-shaped recess of the mounting means for said second arm to transmit rotation from said cam member to the mounting means for said second arm to produce pivotal movement of said second arm about said another inclined axis.

9. A toy action figure comprising a hollow torso, first and second arms, one of which arms is mounted for rotation relative to said torso, first and second legs, one of which legs is mounted for movement relative to said torso, and an actuating mechanism for transmitting motion from said one leg to said one arm, said actuating mechanism including a rotatable cam having a spiral rib thereon, and means on said one leg for coacting with said rib to rotate said cam so that when said cam is rotated by said one leg, rotation of said one arm occurs.

10. A toy action figure in accordance with claim 9 in which said cam and said one arm are rotatable about the same axis.

11. A toy action figure in accordance with claim 9 in which said cam and said one arm are rotatable about different axes.

12. A toy action figure in accordance with claim 9 in which said actuating mechanism includes a follower member having an opening therein providing a notch for receiving said rib, said follower member being shiftable laterally to cause rotation of said cam.

13. A toy action figure in accordance with claim 12 in which both of said arms are mounted for rotation about the same axis, a second cam rotatable about the same axis as said first-mentioned cam, said second cam having a spiral rib and said follower member having a second opening therein providing a second notch for receiving the rib of said second cam so that when said follower member is shifted laterally rotation of both cams occurs.

14. A toy action figure in accordance with claim 12 in which said arms are both mounted about axes inclined with respect to the axis of rotation of said cam, and means for coupling said cam to both arms so that when said follower member is shifted laterally said cam rotates to cause rotation of both arms.

15. A toy action figure comprising a hollow torso, first and second arms, first means mounting said first arm to said torso for rotative movement on a first axis, first and second legs, second means mounting said first leg to said torso for rocking movement about a second axis, and an actuating mechanism within said torso connecting said first leg to said first arm for causing rotative movement of said first arm on said first axis when said first leg is rocked about its said second axis in the direction toward said second leg, said actuating mechanism comprising cam means coupled to said first means including a cylindrical body and angled means extending along said body and rotatable on said first axis, and additional means coupled to said second means and engaged with said cam means for rotating said cam means on said first axis to effect a rotative movement of said first arm when said first leg is rocked, said additional means including a member movable along said angled means while engaged therewith to cause rotation of said cylindrical body, said cylindrical body being coupled to said first arm to effect rotative movement of said first arm when said cylindrical body is rotated.

16. A toy action figure in accordance with claim 15 in which said angled means constitutes a spiral rib.

17. A toy action figure in accordance with claim 15 in which said angled means is curved.

18. A toy action figure in accordance with claim 15 in which said angled means projects from said cylindrical body.

* * * * *